US007481423B2

(12) United States Patent
Lim et al.

(10) Patent No.: US 7,481,423 B2
(45) Date of Patent: Jan. 27, 2009

(54) PRINT MEDIUM FEEDING APPARATUS AND IMAGE FORMING APPARATUS USING THE SAME

(75) Inventors: Kwang-taek Lim, Gwangmyeong-si (KR); Sang-yob Shin, Suwon-si (KR); Yong-kon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 147 days.

(21) Appl. No.: 11/371,097

(22) Filed: Mar. 9, 2006

(65) Prior Publication Data

US 2007/0001376 A1 Jan. 4, 2007

(30) Foreign Application Priority Data

Jun. 30, 2005 (KR) ..... 10-2005-0057906

(51) Int. Cl.
*B65H 3/52* (2006.01)

(52) U.S. Cl. ..... 271/118; 271/121; 271/124

(58) Field of Classification Search ..... 271/118, 271/121, 122, 124, 126, 157
See application file for complete search history.

(56) References Cited

U.S. PATENT DOCUMENTS 4,717,139 A * 1/1988 Sootome et al. ..... 271/116
5,253,854 A * 10/1993 Tanoue et al. ..... 271/10.12
5,316,285 A * 5/1994 Olson et al. ..... 271/122
5,358,230 A * 10/1994 Ikemori et al. ..... 271/114
5,386,983 A * 2/1995 Ando ..... 271/118
5,934,664 A * 8/1999 Murayama et al. ..... 271/118
5,984,297 A * 11/1999 Tanaka ..... 271/118

FOREIGN PATENT DOCUMENTS

| | | |
|---|---|---|
| JP | 2003-26347 | 1/2003 |
| KR | 1998-118019 | 2/1998 |
| KR | 2000-65530 | 11/2000 |
| KR | 2001-244126 | 8/2001 |
| KR | 2005-19416 | 3/2005 |

OTHER PUBLICATIONS

Office Action issued Jun. 26, 2006 in corresponding Korean Patent Application No. 2005-57906.

* cited by examiner

*Primary Examiner*—David H Bollinger
(74) *Attorney, Agent, or Firm*—Stein, McEwen & Bui, LLP

(57) ABSTRACT

A print medium feeding apparatus, comprising: a knockup plate on which a ream of print medium is stacked thereon; a pickup roller for picking up a sheet of print medium stacked on the knockup plate; a sheet separation member installed in a manner to form a contact nip with the pickup roller, and supplying friction force for separating the print medium sheet by sheet; and a friction pad disposed at an upper side of the sheet separation member, being in front of the contact nip. The print medium feeding apparatus of the present invention features an improved paper feeding capacity in that variable friction force is applied for separating printing medium. Moreover, since the friction pad does not come in contact with the pickup roller, the abrasion rate of the friction pad is much reduced. Furthermore, the material cost can be reduced by reducing the size of the friction pad.

44 Claims, 8 Drawing Sheets

PRINT MEDIUM FEEDING APPARATUS AND IMAGE FORMING APPARATUS USING THE SAME

CROSS-REFERENCE TO RELATED APPLICATIONS

This application claims the benefit of Korean Patent Application No. 2005-57906, filed on Jun. 30, 2005, in the Korean Intellectual Property Office, the disclosure of which is incorporated herein by reference.

BACKGROUND OF THE INVENTION

1. Field of the Invention

An aspect of the present invention relates in general to a print medium feeding apparatus and an image forming apparatus using the same, and more specifically, to a print medium feeding apparatus for preventing double feeding, and an image forming apparatus using the same.

2. Description of the Related Art

An image forming apparatus is used for printing or scanning data that are generated internally or externally. For example, copy machines, printers, facsimiles, scanners, etc., are image forming apparatuses now broadly used. Each of these image forming apparatuses is equipped with an automatic paper feeding apparatus feeding paper sheets to output or receive data generated internally or externally.

The automatic paper feeding apparatus has a sheet separation member for feeding sheets one by one so that double feeding (i.e., more than one sheet of paper is fed at once) does not occur.

FIG. 1 is an enlarged detail view of a paper feeding unit used in a related art electrophotographic image forming apparatus 1, and FIG. 2 is an enlarged perspective view of a sheet separation member of FIG. 1.

Referring to FIGS. 1 and 2, the paper feeding unit includes a knockup plate 1 where paper sheets are stacked on, and a pickup roller 5 in contact with the upper side of the knockup plate 1 for picking up a sheet of printing paper 3 extending to the upper side of the knockup plate 1. A friction pad 7 is disposed between the pickup roller 5 and the front end of the knockup plate 1. The friction pad 7 comes in contact with the pickup roller 5 and supplies frictional force for separating the printing paper 3 sheet by sheet while the printing paper 3 is picked up by the pickup roller 5.

FIG. 2 is an enlarged view illustrating a state where the friction pad 7 is installed. Referring to FIGS. 1 and 2, there is a friction pad mount 9 supporting the friction pad 7. Thus, the friction pad 7 is mounted on the upper side of the friction pad mount 9. Here, a nip portion is formed between the friction pad 7 and the pickup roller 5.

Meanwhile, paper sheets of diverse sizes pass between the friction pad 7 and the pickup roller 5. Therefore, the friction pad 7 is made from optimum materials having a proper friction coefficient adaptive to different types of paper.

However, since the friction pad 7 is in contact with the pickup roller 5 at a constant pressure all the time, sometimes it fails to cope with the friction force of each of the paper sheets according to their properties. Consequently, printing papers are not separated sheet by sheet as they are supposed to, and double feeding or slipping occurs.

Moreover, as the pickup roller 5 is in direct contact with the friction pad 7, the friction pad 7 is easily worn out.

Although a large friction pad may be manufactured, this only gives rise to an increase in the material cost.

SUMMARY OF THE INVENTION

Aspects of the present invention provide a paper feeding apparatus equipped with an improved friction pad providing friction force correspondingly to different types of paper sheets, thereby preventing the occurrence of double feeding and slippage.

Another aspect of the present invention is provides a paper feeding apparatus capable of reducing the abrasion rate of a friction pad.

Still another aspect of the present invention provides a paper feeding apparatus capable of reducing the material cost of a friction pad.

Yet another aspect of the present invention provides an image forming apparatus using the above-described paper feeding apparatus.

To achieve the above and/or other aspects and advantages, there is provided a paper feeding apparatus, including: a paper feeding tray on which a ream of printing papers are stacked; a pickup roller to pick up a sheet of printing paper stacked on the paper feeding tray; a sheet separation member installed in a manner to form a contact nip with the pickup roller, and supplying friction force for separating the printing paper sheet by sheet; and a friction pad disposed at an upper side of the sheet separation member, being in front of the contact nip.

The sheet separation member may, although not necessarily, be formed of a mold.

The sheet separation member may, although not necessarily, comprise a contact surface coming in contact with the pickup roller, and a friction pad mount groove into which the friction pad is inserted.

An interface between the contact surface and the mount groove may, although not necessarily, be inclined.

A predetermined gap is provided between an upper side of the friction pad mounted at the mount groove and the contact surface.

Another aspect of the present invention provides an image forming apparatus, including: a knockup plate on which a ream of printing papers are stacked; an elastic member for supporting the knockup plate in an upward direction; a pickup roller to pick up the printing papers stacked on the knockup plate; an image formation unit to form a predetermined image on a sheet of printing paper transported through the pickup roller; a sheet separation member installed in a manner to form a contact nip with the pickup roller, and supplying friction force for separating the printing papers picked up by the pickup roller sheet by sheet; and a friction pad disposed at an upper side of the sheet separation member, being in front of the contact nip.

The sheet separation member may, although not necessarily, be formed of a mold.

The sheet separation member comprises a contact surface coming in contact with the pickup roller, and a friction pad mount groove into which the friction pad is inserted.

An interface between the contact surface and the mount groove may, although not necessarily, be inclined.

A predetermined gap is provided between an upper side of the friction pad mounted at the mount groove and the contact surface.

Moreover, since the friction pad does not come in contact with the pickup roller, the abrasion rate of the friction pad is much reduced.

Furthermore, the material cost can be reduced by reducing the size of the friction pad.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 5A-5C are drawings illustrating the operational flow of a paper feeding unit of the image forming apparatus of FIG. 3, in which FIG. 5A illustrates a state where a sheet of paper is in a paper feeding-standby position, FIG. 5B illustrates a paper feeding state, and FIG. 5C illustrates a state where paper feeding is completed and a double feeding prevention member is in operation;

DETAILED DESCRIPTION OF THE EMBODIMENTS

Figure 1:
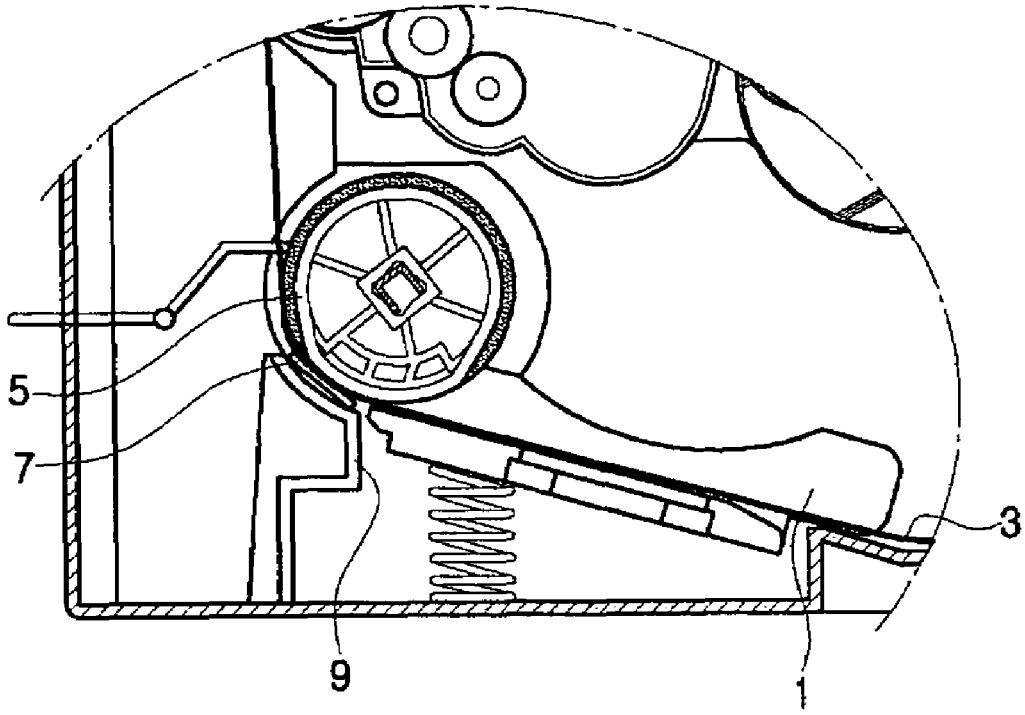
FIG. 1 (PRIOR ART)
FIG. 1 is an enlarged detail view of a paper feeding unit used in a related art electrophotographic image forming apparatus.
Figure 2:
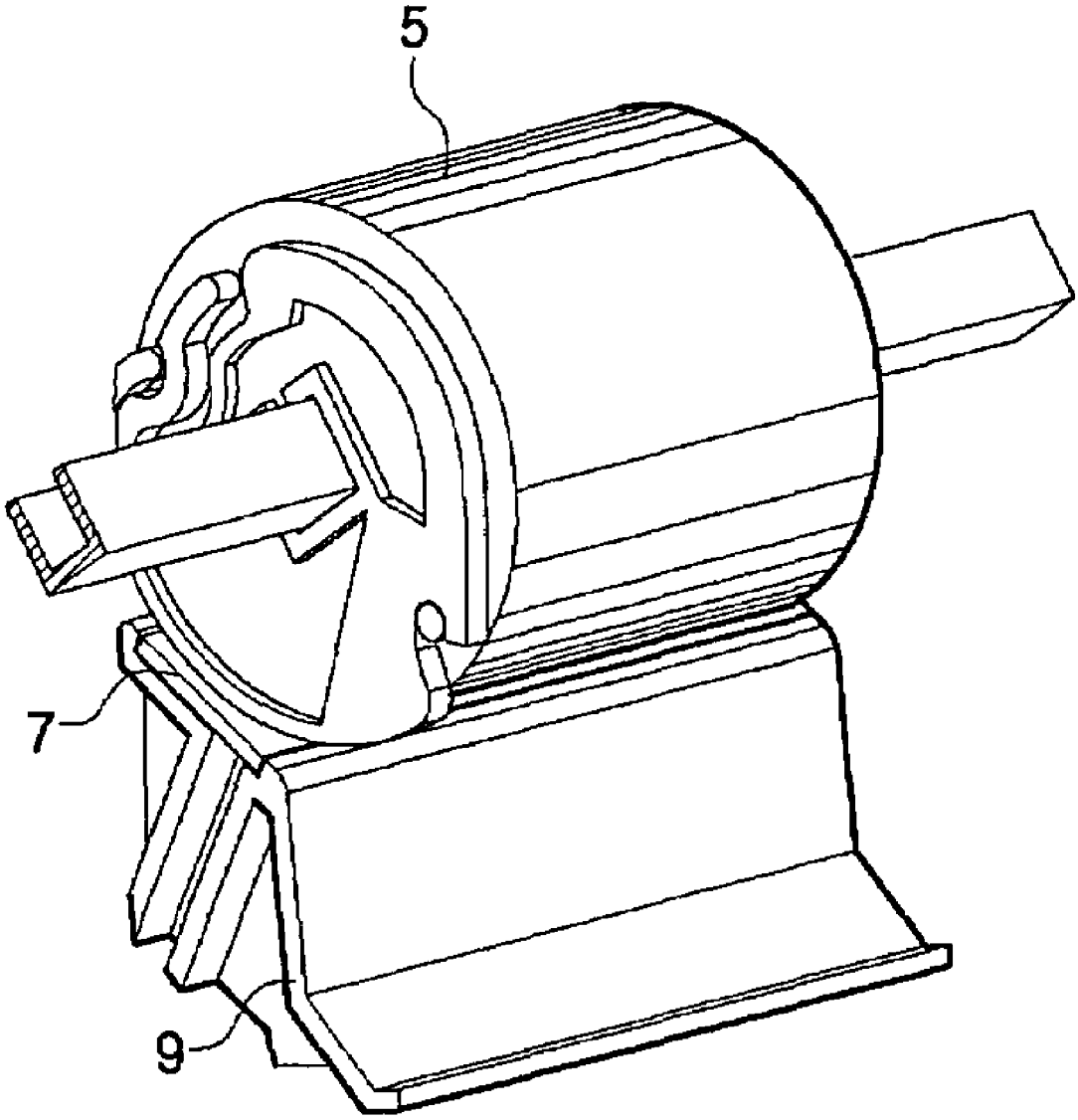
FIG. 2 (PRIOR ART)
FIG. 2 is an enlarged perspective view of a sheet separation member of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
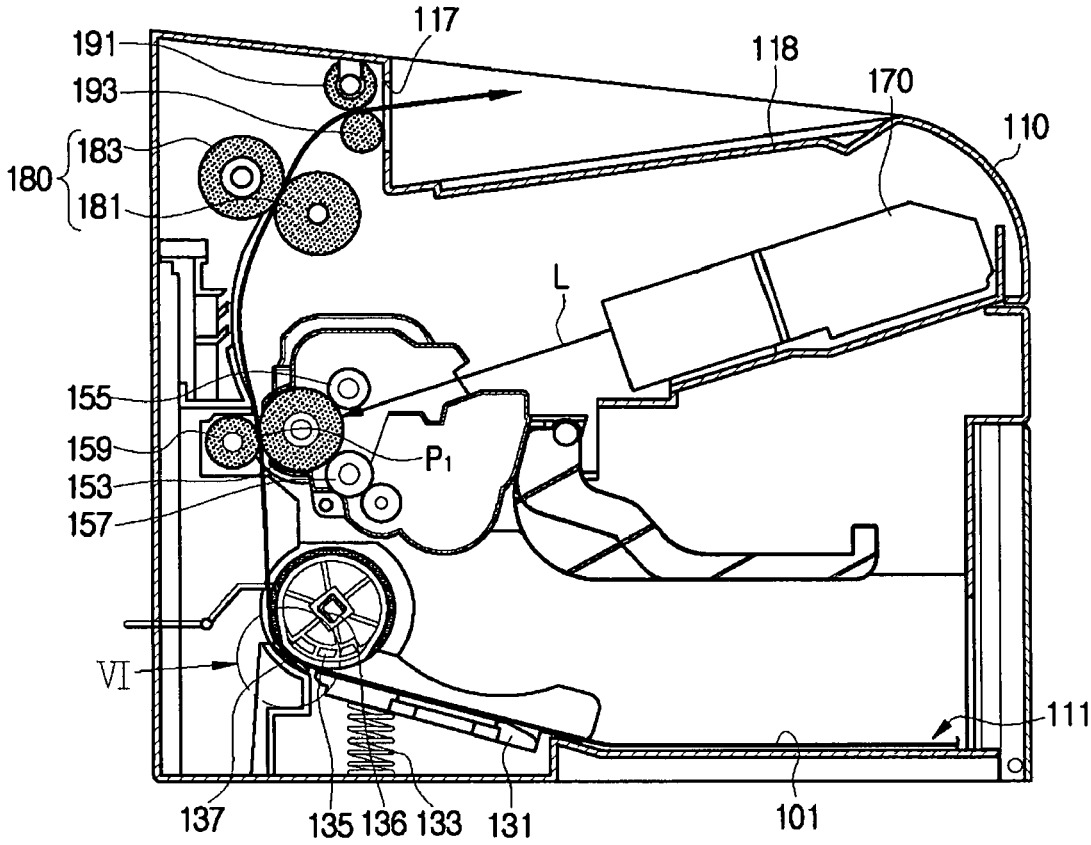
FIG. 3 is a schematic cross-sectional view of an image forming apparatus according to an embodiment of the present invention.

FIG. 3 is a cross-sectional view illustrating the configuration of an image forming apparatus according to an embodiment of the present invention.

Referring to FIG. 3, a paper feeding tray 111 is provided at a lower portion inside a main body 110, and a knockup plate 131 where a ream of printing papers 101 are stacked thereon is mounted on the top of the paper feeding tray 111. When a pickup roller 135 rotates, the printing papers 101 stacked on the knockup plate 131 are separated due to friction force with a sheet separation member 137 and are supplied sheet by sheet into a nip portion (hereinafter it will be referred to as a transfer nip P1) between a photosensitive drum 153, which is an image formation unit, and a transfer roller 159.

At the same time, the surface of the photosensitive drum 153 is electrically charged by discharge of a charging roller 155. The charged surface of the photosensitive drum 153 is exposed to a specific pattern by laser beams L emitted from a laser scanning unit 170, and therefore a desired electrostatic latent image is formed thereon. Next, as a developing roller 157 adjacent to the surface of the photosensitive drum 153 rotates, a toner image is formed on a portion where the electrostatic latent image is formed. Then, the transfer roller 159 presses the photosensitive drum 153, and while rotating it transfers the toner image formed on the photosensitive drum 153 onto the printing paper 101 that is provided from the paper feeding tray 111.

The printing paper 101 moves continuously and passes between a heating roller 181 and a pressing roller 183 of a fixing unit 180, where the image is heated and pressed at a predetermined temperature and a predetermined pressure. As a result, a powder toner image is fixed on the printing paper.

The printing paper bearing the toner image is conveyed by rotation force of a delivery roller 191 and an idle roller 193, and is eventually discharged through a discharge opening 117 and stacked on a paper delivery tray 118.

Figure 4:
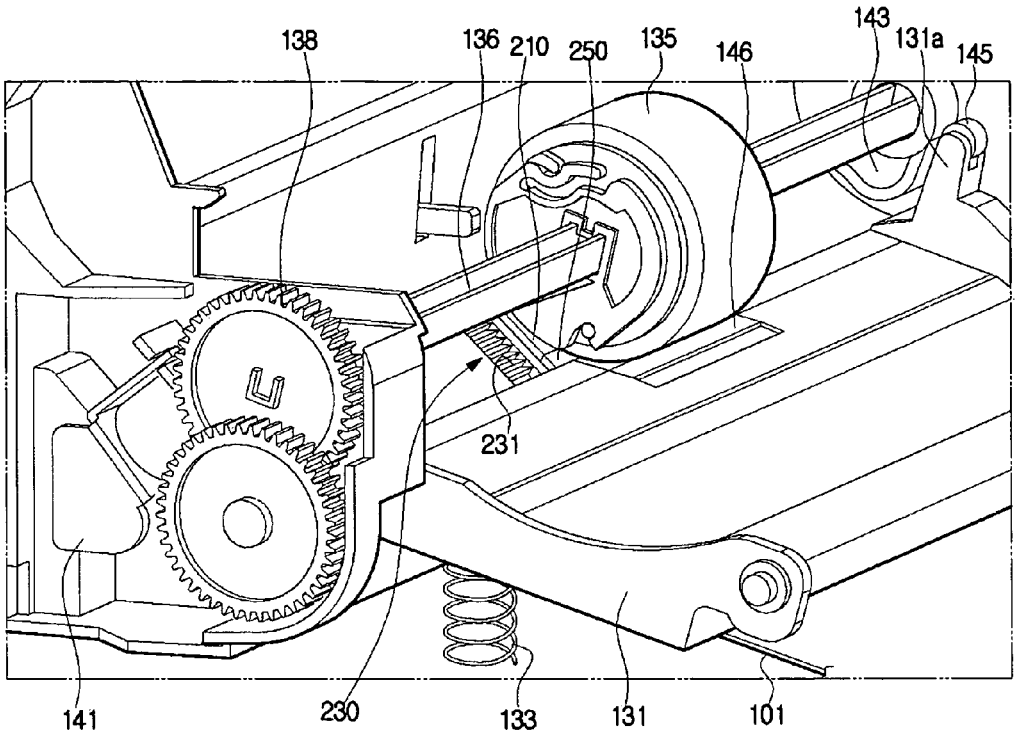
FIG. 4 is an enlarged perspective view illustrating the configuration of a paper feeding unit used in the image forming apparatus of FIG. 3.

FIG. 4 is a perspective view showing the configuration of a paper feeding unit used in the image forming apparatus shown in FIG. 3.

As shown in FIGS. 3 and 4, a knockup plate 131 where printing papers 101 are stacked on is supported by an elastic member 133 in an upward direction. A pickup roller 135 for picking up the printing papers 101 is installed on the upper side of the knockup plate 131. As shown in FIG. 4, a sheet separation member 210 is disposed between the front end of the knockup plate 131 and the pickup roller 135. Additionally, one or more double feeding prevention members 230 may be installed on either or both sides of the sheet separation member 210, respectively, as a complement to the paper separation.

The pickup roller 135 rotates to a certain extent to supply the printing papers 101 sheet by sheet, and stops running for a predetermined amount of time until another sheet of paper is fed. This process is performed under the control of a control unit. The control unit comprises a pickup gear 138 and a solenoid unit 141. The pickup gear 138 is connected to a pickup shaft 136 supporting the rotation of the pickup roller 135, and the solenoid unit 141 selectively transfers or intercepts a driving force to the pickup gear 138 by selectively contacting or separating from the pickup gear 138.

On the other side of the pickup shaft 136 connected to the solenoid unit 141 is provided a cam 143, and a protruded portion 131*a* coming in contact with the cam 143 is provided on the knockup plate 131. Also, an idle roller 145 coming in contact with the cam 143 is provided at the protruded portion 131*a*.

Referring to FIG. 4, a friction member 146 contacts the pickup roller 135, providing a friction force to pick up the printing paper.

Figure 5A:
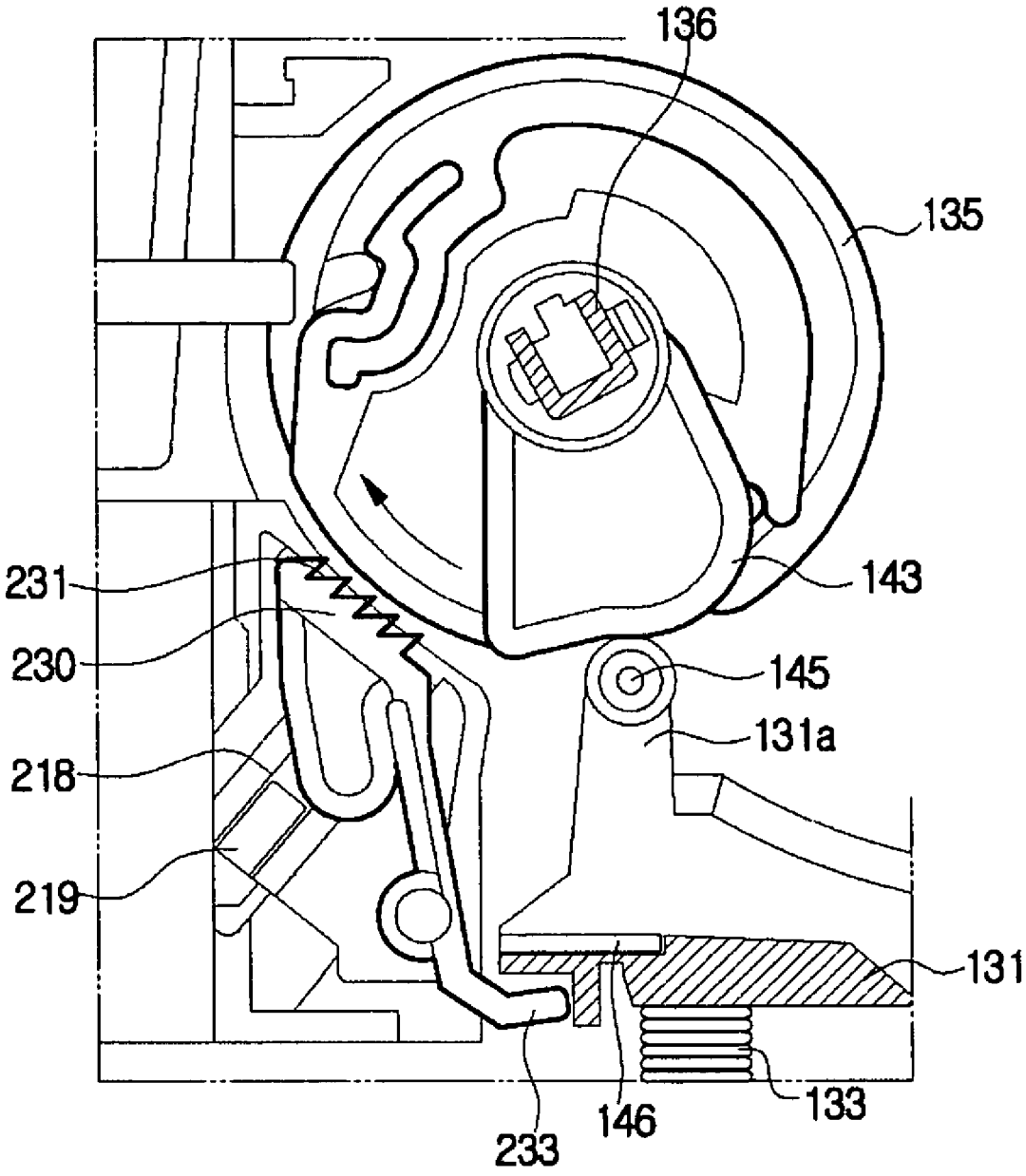
Figure 5B:
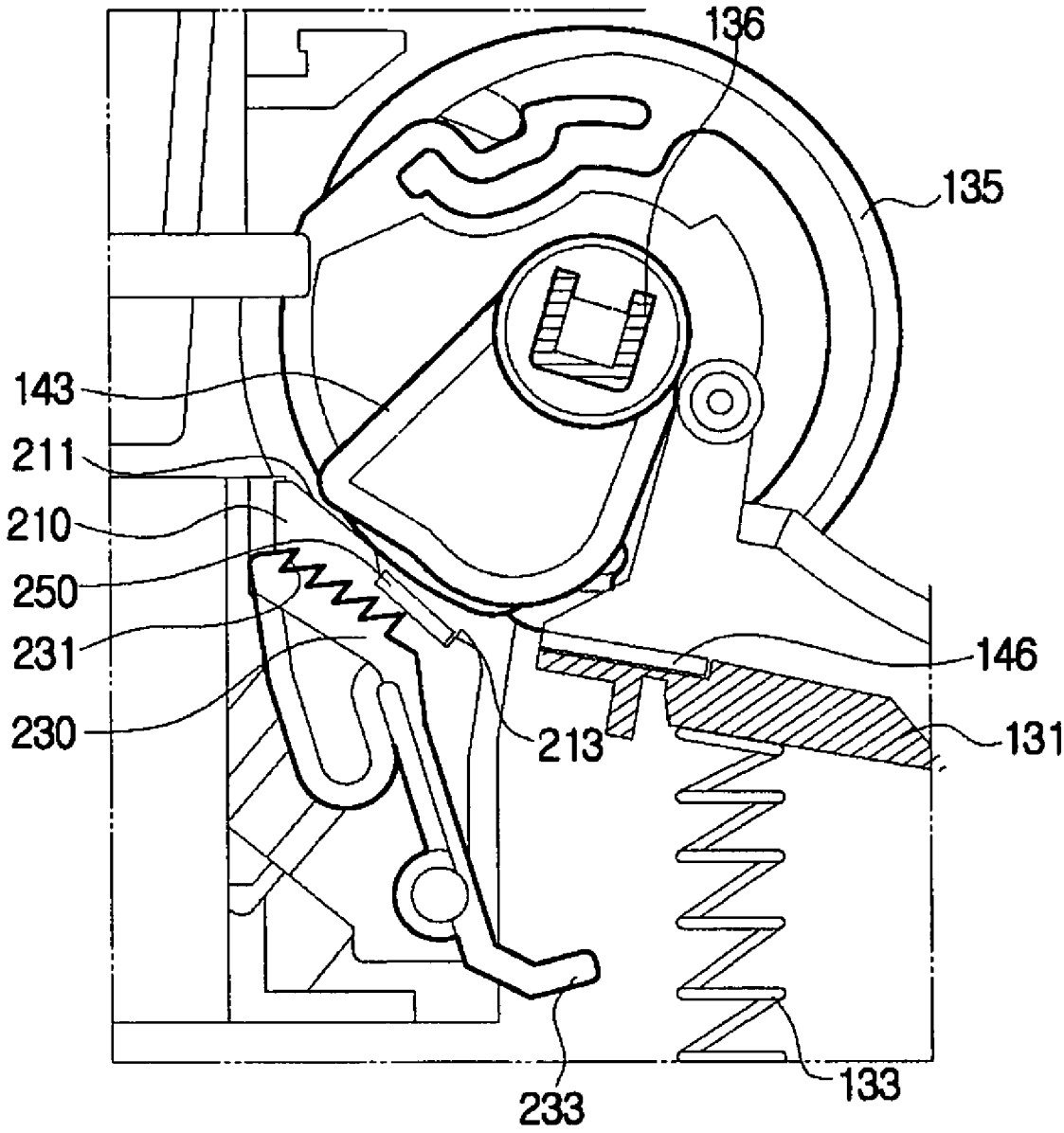
Figure 5C:
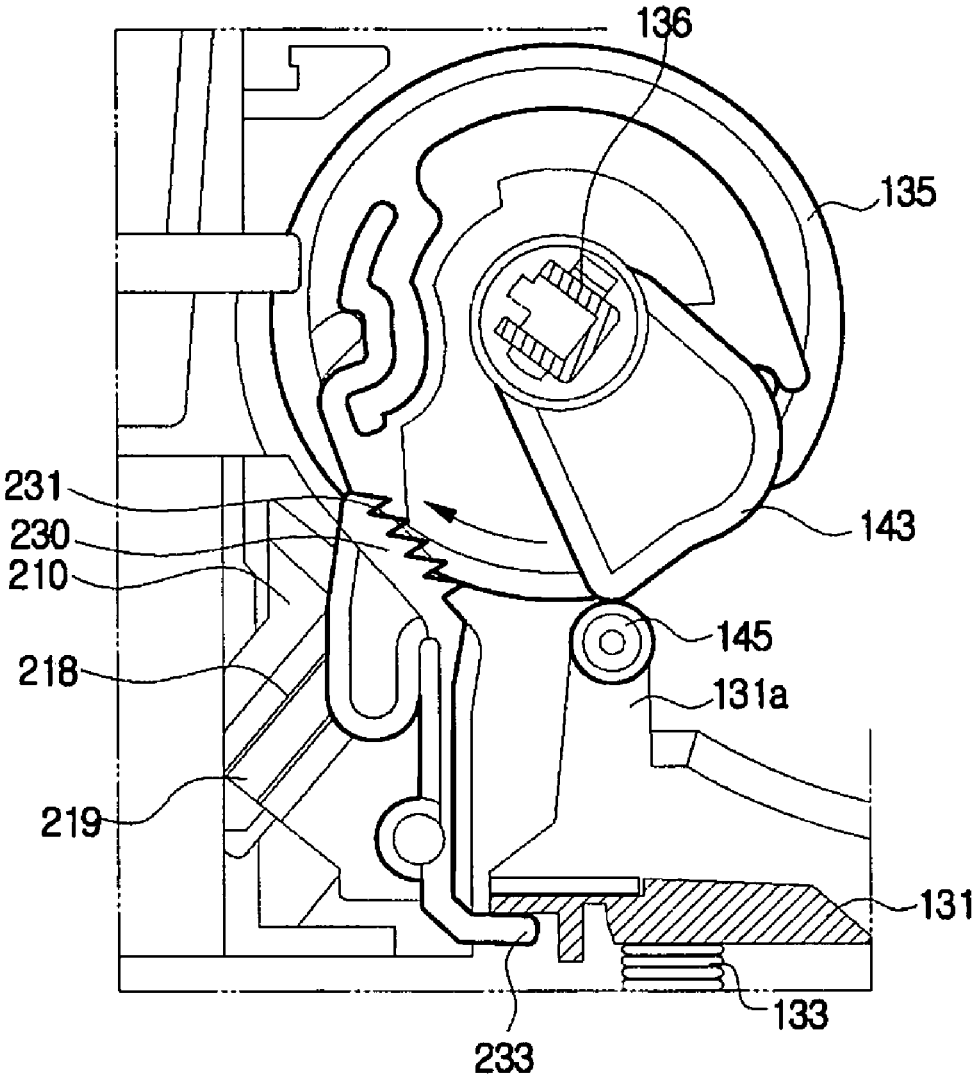

FIGS. 5A-5C illustrate the operational flow of the paper feeding unit of the present invention, in which FIG. 5A illustrates a state where a sheet of paper is in a paper feeding-standby position, FIG. 5B illustrates a paper feeding state, and FIG. 5C illustrates a state where paper feeding is completed and the double feeding prevention member is in operation.

As shown in FIG. 5A, in standby mode, the knockup plate 131 is pressed against the cam 143 by the elastic member 133. In this state, when a user stacks sheets of paper on the knockup plate 131 and inputs a print command, the solenoid unit 141 starts running and a driving force is transferred to the pickup gear 138 (refer to FIG. 4). Then, the pickup roller 135 starts rotating and picks up the printing paper 101 loaded on the knockup plate 131.

In detail, the pickup roller 135 rotates in the clockwise direction, and the cam 143 that moves interlockingly with the pickup roller 135 is separated from the knockup plate 131. Thus, the knockup plate 131 goes up by the elastic force from the elastic member 133 and the automatic paper feeding state is established as shown in FIG. 5B.

The printing paper 101 picked up by the pickup roller 135 passes between the pickup roller 135 and the sheet separation member 210.

When the paper feeding is completed, the knockup plate 131 comes in contact with the edge of the cam 143 as shown in FIG. 5C, and descends to a lower position than the position shown in FIG. 5B until the sheet separation member 210 and the lower end 233 of the double feeding preventing member 230 come in contact with the lower end portion of the knockup plate 131. The sheet separation member 210 descends through a guide rib 219. The double feeding prevention member 230 comprises a saw tooth portion 231 provided on the upper end part of the double feeding prevention member 230, to which the central part of the double feeding prevention member 230 is hinged. The saw tooth portion 231 rotates instantaneously towards the pickup roller 135. Also, a rail 218 is formed on one side of the sheet separation member 210 corresponding to the guide rib 219. Here, the sheet separation member 210 is elastically supported against the pickup roller 135 by an elastic force from a spring (not shown) similar to the elastic member 133. Therefore, as depicted in FIG. 5C, when the sheet separation member 210 descends, the spring remains compressed. Meanwhile, when the knockup plate 131 ascends and is separated from the lower end 215 of the sheet separation member 210, the spring snaps back by its restoring force.

The reason for descending the sheet separation member 210 as described above is to create a predetermined space from the pickup roller 135, and therefore to minimize the friction load between the photosensitive drum 153 and the transfer roller 159 while the printing paper 101 passes a feed roller, i.e., the photosensitive drum 153 and the transfer roller 159 of FIG. 3, located at the next stage of the pickup roller 135.

In addition, the upper end portion of the double feeding prevention member 230 rotates instantaneously towards the pickup roller 135 in order to push a lower sheet of paper stuck to an upper sheet of paper (i.e., in case of double feeding) in an opposite direction from the feeding direction, thereby making sure that the printing papers 101 are supplied sheet by sheet all the time.

Figure 6:
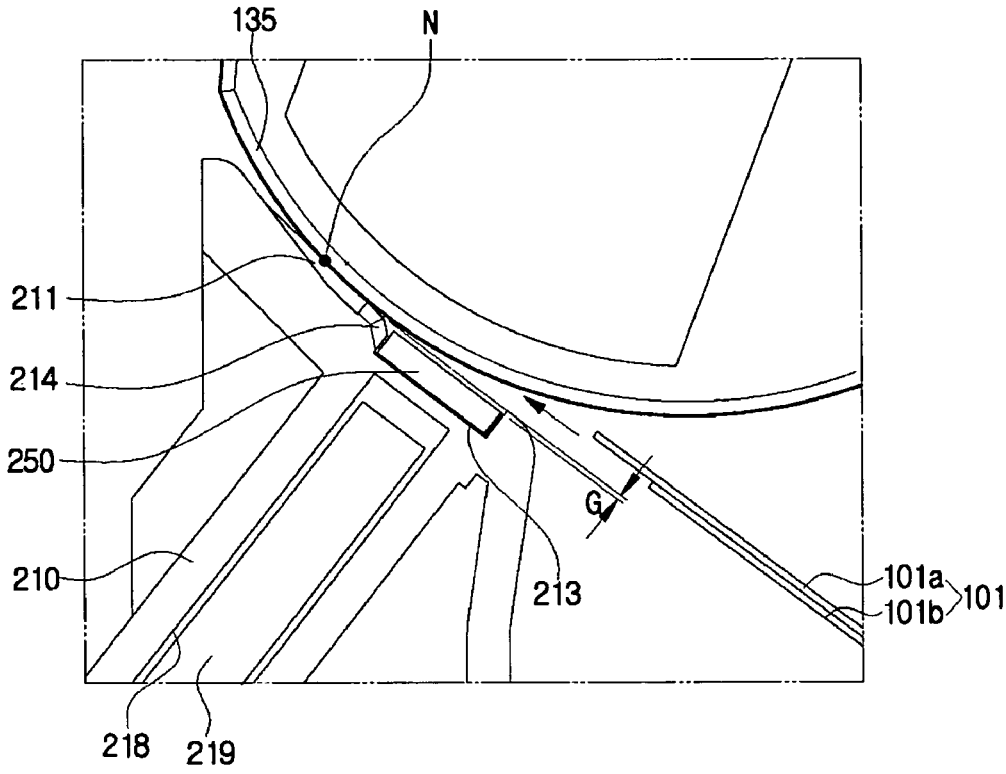
FIG. 6 is an enlarged cross-sectional view of VI portion of FIG. 3 in a sheet separation member of the image forming apparatus of FIG. 3.
Figure 7:
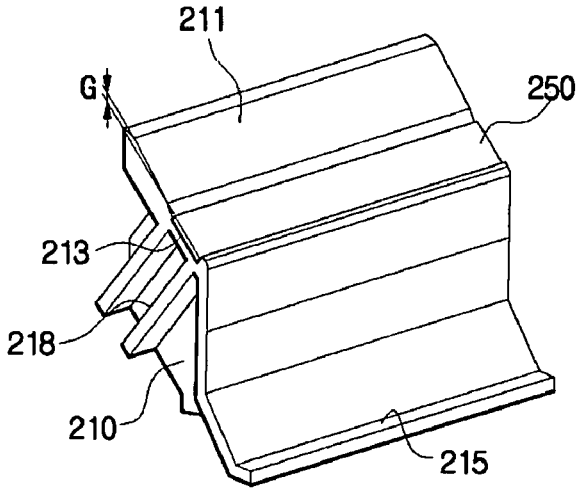
FIG. 7 is a perspective view of a sheet separation member of the image forming apparatus of FIG. 3.

FIG. 6 is an enlarged cross-sectional view of VI portion of FIG. 3 in the sheet separation member applied to the present invention, and FIG. 7 is a perspective view of the sheet separation member applied to the present invention.

Referring to FIGS. 5B, 6, and 7, a first contact nip N is provided between the sheet separation member 210 and the pickup roller 135. Here, the sheet separation member 210 is formed of a mold. The friction pad 250 is placed on the upper side of the sheet separation member 210 disposed in front of the contact nip N. By placing the friction pad 250 on the front end portion of the sheet separation member 210, its width is reduced by half, compared with the related art.

The sheet separation member 210 comprises a contact surface 211 forming the first contact nip N with the pickup roller 135, and a friction pad mount groove 213 into which the friction pad 250 is inserted therein. Here, the interface between the contact surface 211 and the mount groove 213 is inclined.

Moreover, a predetermined gap G is provided between the upper side of the friction pad 250 disposed at the mount groove 213 and the contact surface 211.

In this manner, the printing paper 101 picked up from the knockup plate 131 through the pickup roller 135 passes through the contact nip N between the contact surface 211 of the sheet separation member 210 and the pickup roller 135. The printing paper 101 being conveyed here hardly comes in contact with the friction pad 250, being almost free of the friction force of the friction pad.

On the other hand, in case that two sheets of printing paper 101*a*, 101*b* are fed together (i.e., double feeding) as shown in FIG. 6, the printing paper 101*b* is brought into contact with the friction pad 250 and thus subjected to a friction force. As a result, the printing paper 101*b* is not conveyed and only the printing paper 101*a* on the upper side is fed along the paper transportation pathway.

Although a printer was mainly explained as an example of the image forming apparatus of the present invention, the paper feeding apparatus of the present invention can also be applied to a scanner, a facsimile, etc., requiring the paper feeding. Furthermore, although printing paper was mainly explained as the object of the present invention, the paper feeding apparatus of the present invention can also be applied to any number of different print medium, such as transparencies, overheads, etc.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A print medium feeding apparatus comprising:

a knockup plate on which print media are stacked;

an elastic member to support the knockup plate in an upward direction;

a pickup roller to pick up sheets of the print media stacked on the knockup plate one sheet at a time;

a sheet separation member provided in a manner to form a contact nip with the pickup roller, and supplying friction force for separating the print medium sheet by sheet; and a friction pad disposed at an upper side of the sheet separation member, being in front of the contact nip so that when multiple sheets of print media are picked up, the friction pad contacts and stops a lower sheet of printing medium, wherein a largest radius of the pickup roller is less than a distance from a center of the pickup roller to the friction pad.

2. The print medium feeding apparatus as claimed in claim 1, wherein the sheet separation member is formed of a mold.

3. The print medium feeding apparatus as claimed in claim 1, wherein the sheet separation member further comprises a contact surface coming in contact with the pickup roller, and a friction pad mount groove into which the friction pad is provided so as to not come into contact with the pickup roller.

4. The print medium feeding apparatus as claimed in claim 3, wherein wherein an interface between the contact surface and the friction pad mount groove is inclined.

5. The print medium feeding apparatus as claimed in claim 3, wherein a predetermined gap is created between an upper side of the friction pad mounted at the friction pad mount groove and the contact surface.

6. The print medium feeding apparatus as claimed in claim 1, wherein the sheet separation member further comprises an elastic member on a bottom side of the sheet separation member to elastically support the sheet separation member against the pickup roller.

7. The print medium feeding apparatus as claimed in claim 6, wherein the sheet separation member further comprises a lower end coming in contact with the knockup plate, so that when the knockup plate descends, it forces the sheet separation member to descend and compress the elastic member.

8. The print medium feeding apparatus as claimed in claim 1, wherein the pickup roller comprises a cam that rotates interlockingly with the pickup roller.

9. The print medium feeding apparatus as claimed in claim 8, wherein the cam comes in contact with and pushes down the knockup plate compressing the elastic member during an idle state of the pickup roller, rotates and is separated from the knockup plate during a print medium feeding state of the print medium feeding apparatus, and comes in contact with the knockup plate and pushes down the knockup plate compressing the elastic member when the print medium feeding is completed.

10. A print medium feeding apparatus comprising:

a knockup plate on which print media are stacked;

an elastic member to support the knockup plate in an upward direction;

a pickup roller to pick up sheets of the print media stacked on the knockup plate one sheet at a time;

a sheet separation member provided in a manner to form a contact nip with the pickup roller, and supplying friction force for separating the print medium sheet by sheet;

a friction pad disposed at an upper side of the sheet separation member, being in front of the contact nip so that when multiple sheets of print media are picked up, the friction pad contacts and stops a lower sheet of printing medium; and a guide rib disposed adjacent to the sheet separation member, wherein movement of the sheet separation member towards and away from the pickup roller is guided by the guide rib.

11. The print medium feeding apparatus as claimed in claim 10, wherein the sheet separation member further comprises a rail along one side corresponding to the guide rib, wherein the sheet separation member is guided in a movement by by the combination of the rail and the guide rib.

12. A print medium feeding apparatus comprising:

a knockup plate on which print media are stacked;

an elastic member to support the knockup plate in an upward direction;

a pickup roller to pick up sheets of the print media stacked on the knockup plate one sheet at a time;

a sheet separation member provided in a manner to form a contact nip with the pickup roller, and supplying friction force for separating the print medium sheet by sheet;

a friction pad disposed at an upper side of the sheet separation member, being in front of the contact nip so that when multiple sheets of print media are picked up, the friction pad contacts and stops a lower sheet of printing medium; and one or more double feeding prevention members disposed on one or both sides of the sheet separation member as a complement to the print medium separation.

13. The print medium feeding apparatus as claimed in claim 12, wherein the double feeding prevention member comprises a saw tooth portion disposed on an upper end of the double feeding prevention member, to which a central part of the double feeding prevention member is hinged, and rotating in an opposite direction from a print medium feeding direction, in order to push a lower sheet of print medium moving with an upper sheet of print medium in a case of double feeding in the opposite direction from the print medium feeding direction.

14. The print medium feeding apparatus as claimed in claim 13, wherein the double feeding prevention member further comprises a lower end coming in contact with the knockup plate, so that when the knockup plate descends, the knockup plate causes the saw tooth portion to rotate upward in the opposite direction from the print medium feeding direction.

15. An image forming apparatus comprising:

a knockup plate on which printing media are stacked;

an elastic member to support the knockup plate in an upward direction;

a pickup roller to pick up sheets of the printing media stacked on the knockup plate one sheet at a time;

an image formation unit to form a predetermined image on a sheet of print medium transported through the pickup roller;

a sheet separation member provided in a manner to form a contact nip with the pickup roller, and supplying friction force for separating the print medium picked up by the pickup roller sheet by sheet; and a friction pad disposed at an upper side of the sheet separation member, being in front of the contact nip so that when multiple sheets of print media are picked up, the friction pad contacts and stops a lower sheet of print medium, wherein a largest radius of the pickup roller is less than a distance from a center of the pickup roller to the friction pad.

16. The image forming apparatus as claimed in claim 15, wherein the sheet separation member is formed of a mold.

17. The image forming apparatus as claimed in claim 15, wherein the sheet separation member further comprises a contact surface coming in contact with the pickup roller, and a friction pad mount groove into which the friction pad is provided so as to not come into contact with the pickup roller.

18. The image forming apparatus as claimed in claim 17, wherein an interface between the contact surface and the mount groove is inclined.

19. The image forming apparatus as claimed in claim 17, wherein a predetermined gap is created between an upper side of the friction pad mounted at the friction pad mount groove and the contact surface.

20. The image forming apparatus as claimed in claim 15, wherein the sheet separation member further comprises an elastic member on a bottom side of the sheet separation member to elastically support the sheet separation member against the pickup roller.

21. The image forming apparatus as claimed in claim 20, wherein the sheet separation member further comprises a lower end coming in contact with the knockup plate, so that when the knockup plate descends, the knockup plate forces the sheet separation member to descend and compress the elastic member.

22. The image forming apparatus as claimed in claim 15, wherein the pickup roller comprises a cam that rotates interlockingly with the pickup roller.

23. The image forming apparatus as claimed in claim 22, wherein the cam comes in contact with and pushes down the knockup plate compressing the elastic member during an idle state of the pickup roller, rotates and is separated from the knockup plate during a print medium feeding state of the print medium feeding apparatus, and comes in contact with the knockup plate and pushes down the knockup plate compressing the elastic member when the print medium feeding state is completed.

24. An image forming apparatus comprising:

a knockup plate on which a ream of printing medium media is are stacked;

an elastic member to support the knockup plate in an upward direction;

a pickup roller to pick up sheets of the printing media stacked on the knockup plate one sheet at a time;

an image formation unit to form a predetermined image on a sheet of print medium transported through the pickup roller;

a sheet separation member provided in a manner to form a contact nip with the pickup roller, and supplying friction force for separating the print medium picked up by the pickup roller sheet by sheet;

a friction pad disposed at an upper side of the sheet separation member, being in front of the contact nip so that when multiple sheets of print media are picked up, the friction pad contacts and stops a lower sheet of print medium; and a guide rib disposed adjacent to the sheet separation member, wherein movement of the sheet separation member towards and away from the pickup roller is guided by the guide rib.

25. The image forming apparatus as claimed in claim 24, wherein the sheet separation member further comprises a rail along one side corresponding to the guide rib, wherein the sheet separation member is guided in a movement by the combination of the rail and the guide rib.

26. An image forming apparatus comprising:

a knockup plate on which a ream of printing medium media is are stacked;

an elastic member to support the knockup plate in an upward direction;

a pickup roller to pick up sheets of the printing media stacked on the knockup plate one sheet at a time;

an image formation unit to form a predetermined image on a sheet of print medium transported through the pickup roller;

a sheet separation member provided in a manner to form a contact nip with the pickup roller, and supplying friction force for separating the print medium picked up by the pickup roller sheet by sheet; and a friction pad disposed at an upper side of the sheet separation member, being in front of the contact nip so that when multiple sheets of print media are picked up, the friction pad contacts and stops a lower sheet of print medium; and one or more double feeding prevention members disposed on one or both sides of the sheet separation member as a complement to the print medium separation.

27. The image forming apparatus as claimed in claim 26, wherein the double feeding prevention member further comprises a saw tooth portion disposed on an upper end of the double feeding prevention member, to which the central part of the double feeding prevention member is hinged, and rotating in an opposite direction from a print medium feeding direction, in order to push a lower sheet of print medium moving with an upper sheet of print medium in a case of double feeding in the opposite direction from the print medium feeding direction.

28. The image forming apparatus as claimed in claim 27, wherein the double feeding prevention member further comprises a lower end coming in contact with the knockup plate, so that when the knockup plate descends, the knockup plate causes the saw tooth portion to rotate upward in the opposite direction from the print medium feeding direction.

29. A sheet separation member supplying friction force for separating print medium sheet by sheet, the sheet separation member comprising:

a contact surface coming in contact with a pickup roller to pick up sheets of print media one sheet at a time;

a friction pad mount groove disposed at an upper side of the sheet separation member; and a friction pad disposed in the fiction pad mount groove and spaced apart from the pickup roller so that when multiple sheets of the print media are picked up by the pickup roller, the friction pad contacts and prevents a lower sheet of print medium from moving, wherein a largest radius of the pickup roller is less than a distance from a center of the pickup roller to the friction pad.

30. The sheet separation member as claimed in claim 29, further comprising an elastic member on a bottom side of the sheet separation member to elastically support the sheet separation member against the pickup roller.

31. The sheet separation member as claimed in claim 29, wherein the sheet separation member is formed of a mold.

32. The sheet separation member as claimed in claim 29, wherein an interface between the contact surface and the friction pad mount groove is inclined.

33. The sheet separation member as claimed in claim 29, wherein a predetermined gap is created between an upper side of the friction pad mounted at the friction pad mount groove and the contact surface.

34. A sheet separation member supplying friction force for separating print medium sheet by sheet, the sheet separation member comprising:

a contact surface coming in contact with a pickup roller to pick up sheets of print media one sheet at a time;

a friction pad mount groove disposed at an upper side of the sheet separation member;

a friction pad disposed in the fiction pad mount groove and spaced apart from the pickup roller so that when multiple sheets of the print media are picked up by the pickup roller, the friction pad contacts and prevents a lower sheet of print medium from moving, wherein the friction pad does not contact the pickup roller; and a rail along one side to guide an up and down movement of the sheet separation member.

35. A method of picking up sheets of print media one sheet at a time, the method comprising:

stacking sheets of print media on a knockup plate that can move towards and away from a pickup roller;

moving the knockup plate towards the pickup roller causing a sheet separation member comprising a contact surface and a friction pad in front of the contact surface to move towards the pickup roller, whereby the contact surface forms a contact nip with the pickup roller;

picking up two sheets of print media moving together with the pickup roller; and preventing continued movement of a lower of sheet of print medium as a result of a friction force from the friction pad of the sheet separation member, wherein a largest radius of the pickup roller is less than a distance from a center of the pickup roller to the friction pad.

36. The method as claimed in claim 35, wherein the friction pad and the pickup roller never come into contact with each other.

37. A method of picking up sheets of print media one sheet at a time, the method comprising:

stacking sheets of print media on a knockup plate that can move towards and away from a pickup roller;

moving the knockup plate towards the pickup roller causing a sheet separation member comprising a contact surface and a friction pad in front of the contact surface to move towards the pickup roller, whereby the contact surface forms a contact nip with the pickup roller and the friction pad does not contact the pickup roller;

picking up two sheets of print media moving together with the pickup roller;

preventing continued movement of a lower of sheet of print medium as a result of a friction force from the friction pad of the sheet separation member; and moving the knockup plate away from the pickup roller causing the sheet separation member to move away from the pickup roller and a double feeding prevention member to rotate upwards in an opposite direction from a print medium feeding direction in order to push the lower sheet of print medium in the opposite direction from the print medium feeding direction.

38. The method as claimed in claim 37, wherein the double feeding prevention member comprises a saw tooth portion disposed at a top surface to catch the lower sheet of print medium.

39. A double feeding prevention apparatus comprising:

a sheet separation member to form a contact nip with a pickup roller, and supplying friction force for preventing continued movement of a lower sheet of print medium when more than one sheet of print medium is picked up; and a double feeding prevention member that catches the lower sheet of print medium and pushes the lower sheet in an opposite direction from a print medium feeding direction, wherein the sheet separation member comprises:

an elastic member on a bottom side of the sheet separation member to elastically support the sheet separation member against the pickup roller, and a rail along one side to guide an up and down movement of the sheet separation member.

40. The double feeding prevention apparatus as claimed in claim 39, wherein the sheet separation member comprises:

a contact surface coming in contact with the pickup roller;

a friction pad mount groove disposed at an upper side of the sheet separation member; and a friction pad disposed in the fiction pad mount groove and spaced apart from the pickup roller so that when multiple sheets of print media are picked up, the friction pad contacts and prevents a lower sheet of print medium from moving, wherein the friction pad does not contact the pickup roller.

41. The double feeding prevention apparatus as claimed in claim 40, wherein an interface between the contact surface and the friction pad mount groove is inclined.

42. The double feeding prevention apparatus as claimed in claim 40, wherein a predetermined gap is created between an upper side of the friction pad mounted at the friction pad mount groove and the contact surface.

43. The double feeding prevention apparatus as claimed in claim 39, wherein the sheet separation member is formed of a mold.

44. The double feeding prevention apparatus as claimed in claim 39, wherein the elastic member moves the sheet separation member towards the pickup roller during a print medium feeding state, and moves the sheet separation member away from the pickup roller during an idle state and after a print medium feeding state.

* * * * *